US007836596B2

(12) United States Patent
Suciu et al.

(10) Patent No.: US 7,836,596 B2
(45) Date of Patent: Nov. 23, 2010

(54) TURBINE ENGINE ROTOR RETAINING METHODS

(75) Inventors: Gabriel L. Suciu, Glastonbury, CT (US); James W. Norris, Lebanon, CT (US)

(73) Assignee: United Technologies Corporation, Hartford, CT (US)

( * ) Notice: Subject to any disclaimer, the term of this patent is extended or adjusted under 35 U.S.C. 154(b) by 607 days.

(21) Appl. No.: 11/479,334

(22) Filed: Jun. 30, 2006

(65) Prior Publication Data

US 2007/0107219 A1 May 17, 2007

Related U.S. Application Data

(62) Division of application No. 10/825,256, filed on Apr. 15, 2004, now Pat. No. 7,147,436.

(51) Int. Cl.
*B21K 25/00* (2006.01)

(52) U.S. Cl. ..... 29/889.22; 29/889.2; 29/889.21; 416/198 A; 416/244 A

(58) Field of Classification Search ... 29/889.2–889.22; 416/198 A, 244 A
See application file for complete search history.

(56) References Cited

U.S. PATENT DOCUMENTS

| | | | | |
|---|---|---|---|---|
| 2,749,086 | A | 6/1956 | Lombard | |
| 3,822,953 | A | 7/1974 | Adelizzi | |
| 4,836,750 | A * | 6/1989 | Modafferi et al. | 416/244 A |
| 5,288,210 | A * | 2/1994 | Albrecht et al. | 416/198 A |
| 6,338,578 | B1 | 1/2002 | Adde et al. | |

FOREIGN PATENT DOCUMENTS

| | | |
|---|---|---|
| JP | 54-124845 | 8/1979 |
| JP | 09-273514 A | 10/1997 |

OTHER PUBLICATIONS

European Search Repot for EP Patent Application No. 05252295.0.

* cited by examiner

*Primary Examiner*—Rick K Chang
(74) *Attorney, Agent, or Firm*—Bachman & LaPointe, P.C.

(57) ABSTRACT

A rotor stack is assembled to a turbine engine shaft. A force is exerted to at least one of the rotor stack and the shaft to at least one of place the shaft under tension and place the rotor stack under compression. One or more retainer segments are inserted into a rebate in the shaft. The exerted force is released to permit the rotor stack to bear against the retainer segments.

22 Claims, 4 Drawing Sheets

TURBINE ENGINE ROTOR RETAINING METHODS

CROSS-REFERENCE TO RELATED APPLICATION

This is a divisional application of U.S. patent application Ser. No. 10/825,256, entitled TUBINE ENGINE ROTOR RETAINER, and filed Apr. 15, 2004, now U.S. Pat. No. 7,147,436 the disclosure of which is incorporated by reference herein as if set forth at length.

U.S. GOVERNMENT RIGHTS

The invention was made with U.S. Government support under contract F33615-97-C-2779 awarded by the U.S. Air Force. The U.S. Government has certain rights in the invention.

BACKGROUND OF THE INVENTION

The invention relates to gas turbine engines. More particularly, the invention relates to gas turbine engines having precompressed rotor stacks.

A gas turbine engine typically includes one or more rotor stacks associated with one or more sections of the engine. A rotor stack may include several longitudinally spaced apart blade-carrying disks of successive stages of the section. A stator structure may include circumferential stages of vanes longitudinally interspersed with the rotor disks. The rotor disks are secured to each other against relative rotation and the rotor stack is secured against rotation relative to other components on its common spool (e.g., the low and high speed/pressure spools of the engine).

Numerous systems have been used to tie rotor disks together. In an exemplary center-tie system, the disks are held longitudinally spaced from each other by sleeve-like spacers. The spacers may be unitarily formed with one or both adjacent disks. However, some spacers are often separate from at least one of the adjacent pair of disks and may engage that disk via an interference fit and/or a keying arrangement. The interference fit or keying arrangement may require the maintenance of a longitudinal compressive force across the disk stack so as to maintain the engagement. The compressive force may be obtained by securing opposite ends of the stack to a central shaft passing within the stack. The stack may be mounted to the shaft with a longitudinal precompression force so that a tensile force of equal magnitude is transmitted through the portion of the shaft within the stack.

Alternate configurations involve the use of an array of circumferentially-spaced tie rods extending through web portions of the rotor disks to tie the disks together. In such systems, the associated spool may lack a shaft portion passing within the rotor. Rather, separate shaft segments may extend longitudinally outward from one or both ends of the rotor stack.

Desired improvements in efficiency and output have greatly driven developments in turbine engine configurations. Efficiency may include both performance efficiency and manufacturing efficiency.

Accordingly, there remains room for improvement in the art.

SUMMARY OF THE INVENTION

One aspect of the invention involves a turbine engine having a rotor stack carried by a central shaft. One or more of retainer segments each have a first surface engaging the rotor stack and a second surface engaging the central shaft so as to transmit a precompression force from the central shaft to the rotor stack. The engagement may be direct or indirect.

In various implementations, a collar may secure the retainer segments in place against radial displacement. The retainer segments may be proximate a forward end of the rotor stack. There may be exactly two such retainer segments proximate the forward end. The shaft may have a rebate having a forward surface engaging the retainer segment second surfaces. The rebate may be a full annulus or may be segmented (e.g., like the retainer). The rebate may have an aft surface and a base surface between the forward surface and the aft surface. The base surface may be essentially rearwardly divergent at a half angle in excess of 5°. The forward surface may be essentially within 5° of radial. The precompression force may be at least 50 kN. The rotor may be a high speed compressor rotor. The rotor may lack off-center tie rods.

Another aspect of the invention involves a method including assembling a rotor stack to a turbine engine shaft. A force is exerted between the rotor stack and the shaft to place the shaft under tension and the rotor stack under compression. One or more retainer segments are inserted into a rebate in the shaft. The exerted force is released to permit the rotor stack to bear against the retainer segments.

In various implementations, a collar may be installed at least partially surrounding the retainer segments so as to secure the retainer segments in place against radial displacement. The exerting may compress the rotor stack with a force in excess of 50 kN. The releasing may leave the rotor stack under a precompression force of at least 50 kN. The assembling may include interference fitting an end portion of at least one spacer element within a portion of at least one rotor disk.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
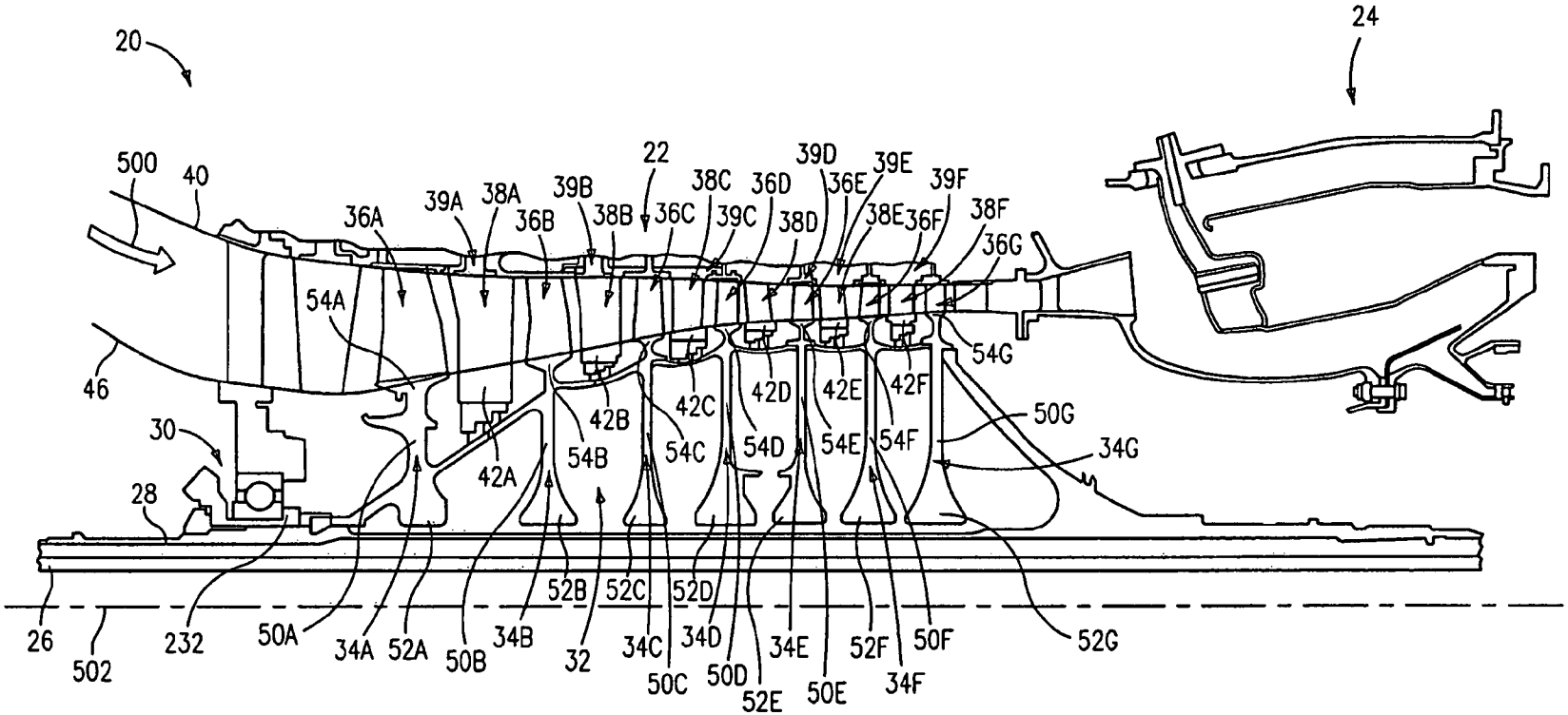
FIG. 1 is a partial longitudinal sectional view of a gas turbine engine.

FIG. 1 shows a gas turbine engine 20 having a high speed/pressure compressor (HPC) section 22 receiving air moving along a core flowpath 500 from a low speed/pressure compressor (LPC) section (not shown) and delivering the air to a combustor section 24. High and low speed/pressure turbine sections (HPT, LPT—not shown) are downstream of the combustor along the core flowpath. The engine may further include a transmission-driven fan (not shown) and an augmentor (not shown) among other systems or features.

The engine 20 includes low and high speed shafts 26 and 28 mounted for rotation about an engine central longitudinal axis or centerline 502 relative to an engine stationary structure via several bearing systems 30. Each shaft 26 and 28 may be an assembly, either fully or partially integrated (e.g., via welding). The low speed shaft carries LPC and LPT rotors and their blades to form a low speed spool. The high speed shaft 28 carries the HPC and HPT rotors and their blades to form a high speed spool. FIG. 1 shows an HPC rotor stack 32 mounted to the high speed shaft 28. The exemplary rotor stack 32 includes, from fore to aft and upstream to downstream, seven blade disks 34A-34G carrying an associated stage of blades 36A-36G. Between each pair of adjacent blade stages, an associated stage of vanes 38A-38F is located along the core flowpath 500. The vanes extend radially inward from outboard platforms 39A-39F formed as portions of a core flowpath outer wall 40 to inboard platforms 42A-42F forming portions of a core flowpath inboard wall 46.

Figure 2:
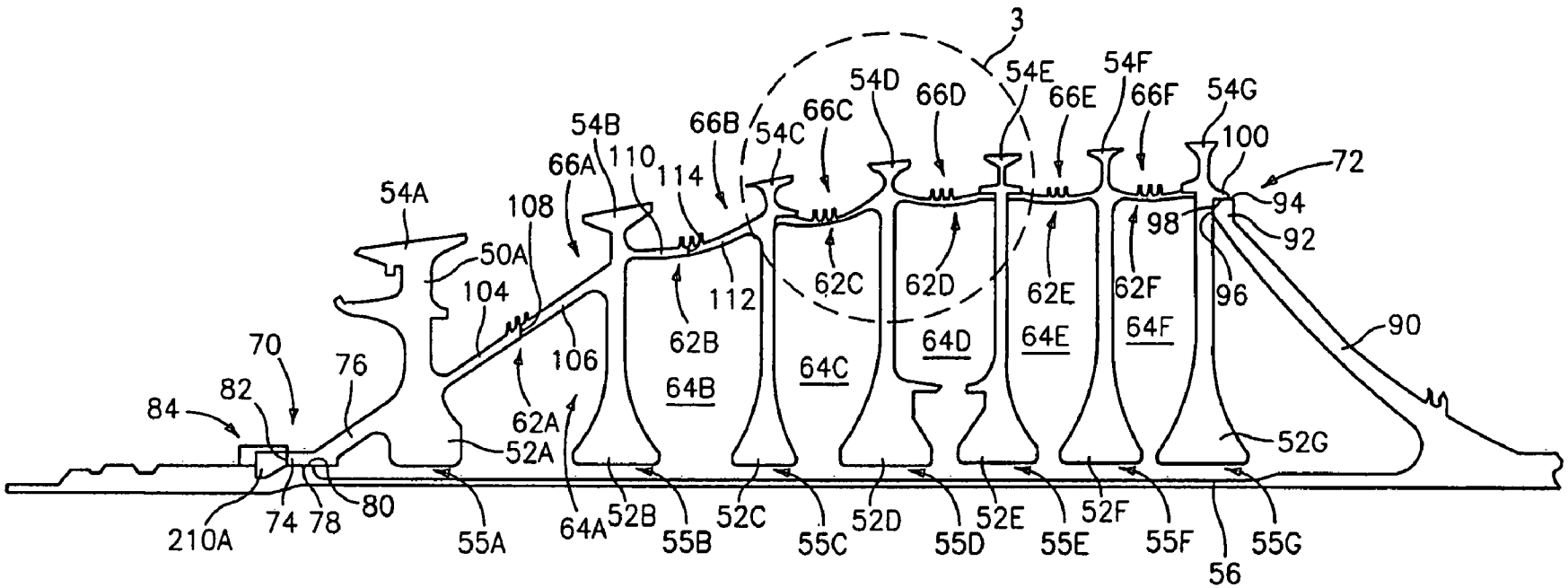
FIG. 2 is a longitudinal sectional view of a high pressure compressor rotor stack of the engine of FIG. 1.

In the exemplary embodiment, each of the disks has a generally annular web 50A-50G extending radially outward from an inboard annular protuberance known as a "bore" 52A-52G to an outboard peripheral portion 54A-54G. The bores 52A-52G encircle central apertures 55A-55G (FIG. 2) of the disks through which a portion 56 of the high speed shaft 28 freely passes with clearance. The blades may be unitarily formed with the peripheral portions 54A-54G (e.g., as a single piece with continuous microstructure), non-unitarily integrally formed (e.g., via welding), or may be removably mounted to the peripheral portions via mounting features such as fir tree blade roots captured within complementary fir tree channels in the peripheral portions.

A series of spacers 62A-62F connect adjacent pairs of the disks 34A-34G and separate associated inboard/interior annular interdisk cavities 64A-64F from outboard/exterior interdisk annular cavities 66A-66F. In the exemplary embodiment, at fore and aft ends 70 and 72, the rotor stack is mounted to the high speed shaft 28 but intermediate (e.g., at the disk bores) is clear of the shaft 28. In the exemplary embodiment, at the fore end 70, an annular collar portion 74 at the end of a frustoconical sleeve portion 76 has an interior surface portion 78 engaging a shaft exterior surface portion 80 and a fore end rim surface 82 engaging a precompressive retainer 84 discussed in further detail below. In the exemplary embodiment, the collar and frustoconical sleeve portions 74 and 76 are unitarily formed with a remainder of the first disk 34A (e.g., at least with inboard portion of the web 50A from which the sleeve portion 76 extends forward). At the aft end 72, a rear hub 90 (which may be unitarily formed with or integrated with an adjacent portion of the high speed shaft 28) extends radially outward and forward to an annular distal end 92 having an outboard surface 94 and a forward rim surface 96. The outboard surface is captured against an inboard surface 98 of a collar portion 100 being unitarily formed with and extending aft from the web 50G of the aft disk 34G. The rim surface 96 engages an aft surface of the web 50G.

In the exemplary engine, the first spacer 62A is formed as a generally frustoconical sleeve extending between the fore surface of the second disk web 50B and the aft surface of the first disk web 50A. The exemplary first spacer 62A is formed of a fore portion 104 and an aft portion 106 joined at a weld 108. The fore portion is unitarily formed with a remainder of the fore disk 34A and the aft portion 106 is unitarily formed with a remainder of the second disk 34B. The exemplary second spacer 62B is also formed of fore and aft portions 110 and 112 joined at a weld 114 and unitarily formed with remaining portions of the adjacent disks 34B and 34C, respectively. However, as discussed in further detail below, the exemplary spacer 62B is of a generally concave-outward arcuate longitudinal cross-section rather than a straight cross-section. In the exemplary engine, the third and fourth spacers 62C and 62D are unitarily formed with the remaining portions of the fourth disk 34D.

Figure 3:
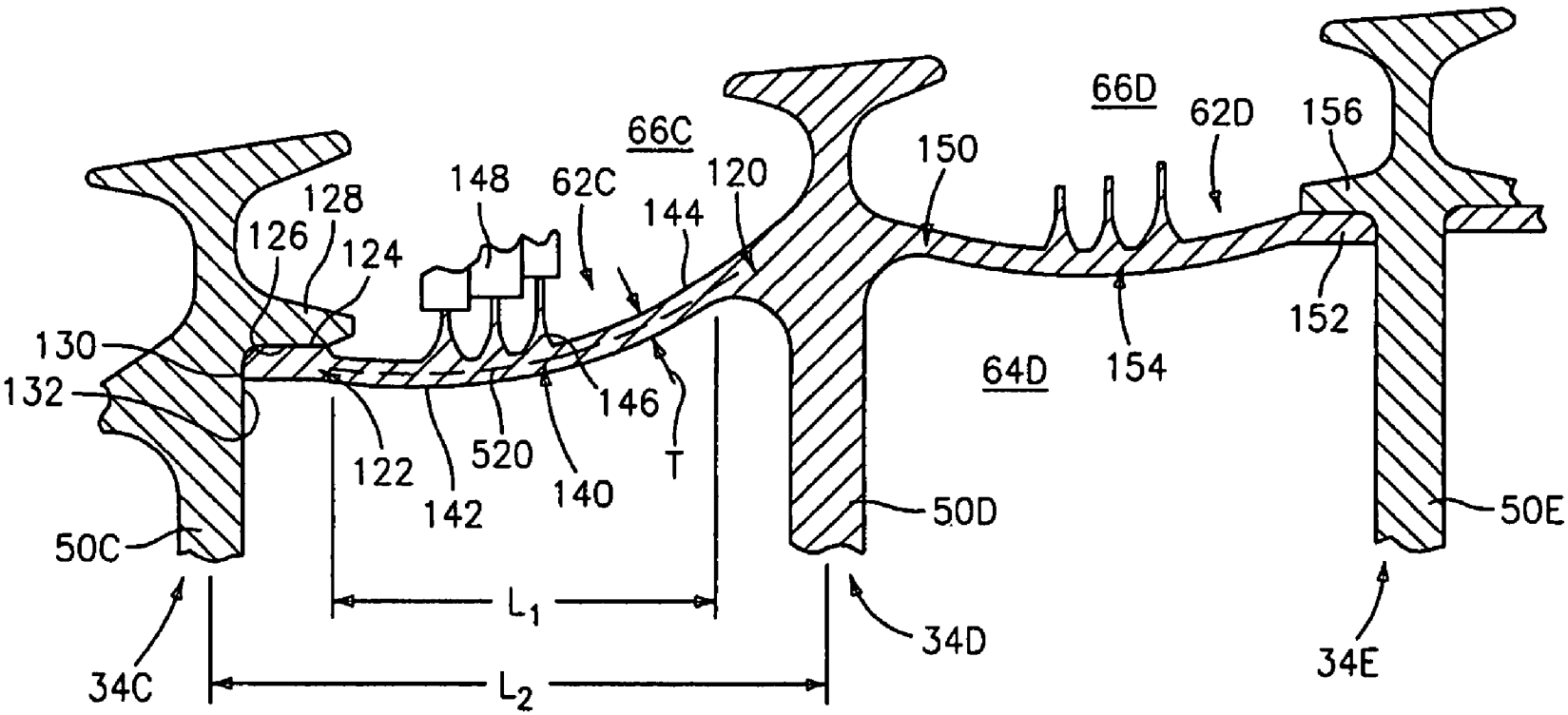
FIG. 3 is a detail view of a portion of the rotor stack of FIG. 2.

FIG. 3 shows the exemplary third spacer 62C as extending forward from a proximal aft end portion 120 at the fourth disk fore surface to a distal fore end portion 122. The fore end portion 122 has an annular outboard surface 124 in force fit relationship with an inboard surface 126 of a collar portion 128 extending aft from the aft surface of the third disk web portion 50C. A forward rim surface 130 of the fore end portion 122 abuts a contacting portion 132 of the third disk web aft surface. In the exemplary embodiment, the surface pairs 124 and 126 and 130 and 132 are in frictional engagement (discussed in further detail below). Optionally, one or both surface pairs may be provided with interfitting keying means such as teeth (e.g., gear-like teeth or castellations). A central portion 140 of the third spacer 62C extends between the end portions 120 and 122. Along this central portion 140, the longitudinal cross-section is concave outward. For example, a median 520 between inboard and outboard surfaces 142 and 144 is concave outward. The spacer may have a series of annular teeth 146 extending outward from its outboard surface 144 for sealing with an abradable seal 148 carried by the associated vane inboard platform. In an exemplary definition of the median, the sealing teeth are ignored. The central portion 140 may have a longitudinal span $L_1$ which may be a major portion of an associated disk-to-disk span or spacing $L_2$. $L_1$ and $L_2$ may be different for each spacer. Exemplary $L_2$ is 4-10 cm. Exemplary $L_1$ is 2-8 cm. Exemplary thickness T along the central portion 140 is 2-5 mm.

In the exemplary engine, the fourth spacer 62D has a proximal fore portion 150, a distal aft portion 152 and a central portion 154. The distal portion 152 may be engaged with a forwardly-projecting collar portion 156 of the fifth disk in a similar manner to the engagement of the third spacer distal portion 122 with the collar portion 128. In the exemplary embodiment, the fifth and sixth spacers 62E and 62F are similarly unitarily formed with the remaining portion of the sixth disk as the third and fourth spacers are with the fourth disk. The fifth and sixth spacers engage the fifth and seventh disks in similar fashion to the engagement of the third and fourth spacers with the third and fifth disks. Other arrangements of the spacers are possible. For example, a spacer need not be unitarily formed with one of the adjacent disks but could have two end portions with similar engagement to associated collar portions of the two adjacent disks as is described above.

The arcuate nature of the spacers 62B-62F may have one or more of several functions and may achieve one or more of several results relative to alternate configurations as is discussed below.

In an exemplary method of manufacture, the disks may be forged from an alloy (e.g., a titanium alloy or nickel- or cobalt-based superalloy). In an exemplary sequence of assembly, the hub 90 (FIG. 2) is preformed with the shaft portion 56 (e.g., unitarily formed with or welded thereto). The shaft may be oriented to protrude upward from the hub. The hub may be cooled to thermally contract the hub and the seventh disk 34G heated to expand the disk. This allows the aft/last disk 34G to be placed over the shaft and seated against the hub, with the hub surface 94 initially passing freely within the disk surface 98 so that the hub surface 96 contacts the disk. Ultimately the two may be allowed to thermally equalize whereupon expansion of the hub and/or contraction of the disk brings the two into a thermal interference fit between the surfaces 94 and 98. However, in the exemplary embodiment, while the seventh disk 34G is still hot, the sixth disk, having been precooled, may promptly be similarly put in place with its sixth spacer distal portion being accommodated radially inside the collar portion of the seventh disk. Again, upon subsequent thermal equalization, there will be an interference fit. Similarly, while the sixth disk is still cool, the preheated fifth disk may be put in place and the precooled fourth disk put in place. The exemplary first through third disks are preformed as a welded assembly. While the fourth disk is still cool, this preheated assembly may be put in place.

Figure 5:
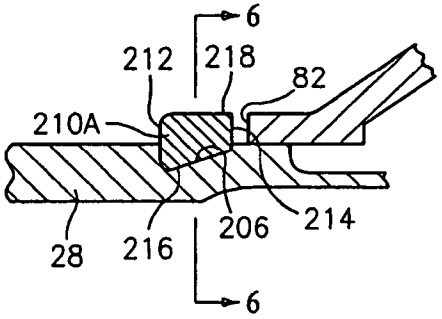
FIG. 5 is a longitudinal sectional view of the leading portion of the rotor stack in a second stage of installation.
Figure 6:
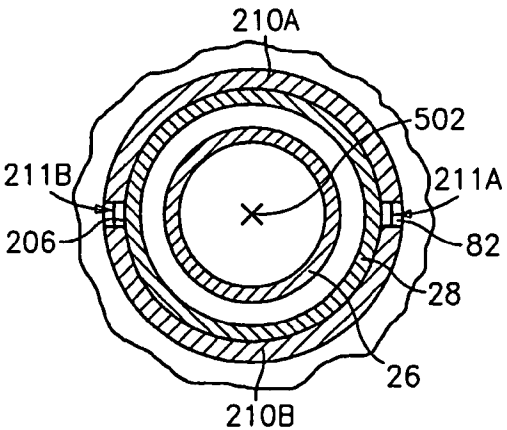
FIG. 6 is a transverse sectional view of a retainer ring locking the rotor stack to the shaft.
Figure 4:
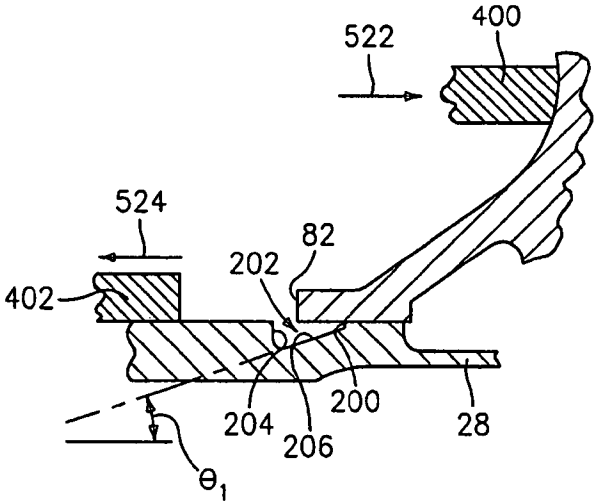
FIG. 4 longitudinal sectional view of a leading portion of the rotor stack in a first stage of installation to the shaft of the engine of FIG. 1.

After the assembly of the exemplary rotor stack, it is necessary to longitudinally precompress the rotor stack. The precompression method may be influenced by nature of the particular retainer 84 used. FIG. 4 shows the exemplary rotor stack in an uncompressed condition. In the exemplary uncompressed condition, the exemplary rim surface 82 is well forward of an aft surface/extremity 200 of an inwardly-extending annular rebate 202 in the shaft 28. The exemplary rebate 202 includes a forward surface 204 and a base surface 206. In the exemplary engine, the base surface 206 is moderately rearwardly divergent at a conical half angle $\theta_1$ (e.g., 5°-20°). The exemplary fore and aft surfaces 204 and 200 are close to radial (e.g., within 5° of radial). A compressive force 522 is applied to the first disk via a fixture portion 400 and an equal and opposite tensile force 524 is applied to the shaft 28 thereahead via a fixture portion 402. This precompresses the rotor stack into an intermediate condition shown in FIG. 5. In this intermediate condition, the rim surface 82 is shifted aft of the rebate aft surface 200. With the rotor stack in the intermediate condition, the retainer may be put in place. The exemplary retainer uses a segmented locking ring having a pair of segments 210A and 210B (FIGS. 5 and 6). In the exemplary retainer, there are two segments, each very slightly under 180° of arc to leave a pair of gaps 211A and 211B between adjacent segment ends. If present, the gaps may prevent interference and permit full seating of the segments. The gaps may, advantageously, be very small to minimize balance problems and are shown in exaggerated scale.

The exemplary segments are generally complementary to the channel having a fore surface 212 (FIG. 5), an aft surface 214, an inboard surface 216, and an outboard surface 218 in generally trapezoidal sectional configuration. The surface intersections may be rounded and the rebate surface intersections may be correspondingly filleted for stress relief. In the exemplary engine, the rebate is a full annulus as discussed above. Alternatively, the rebate may be a segmented annulus (e.g., two segments of slightly less than 180° each with a corresponding reduction in the circumferential span of the interfitting portions of the ring segments 210A and 210B). There also may be more than two retainer segments.

Figure 7:
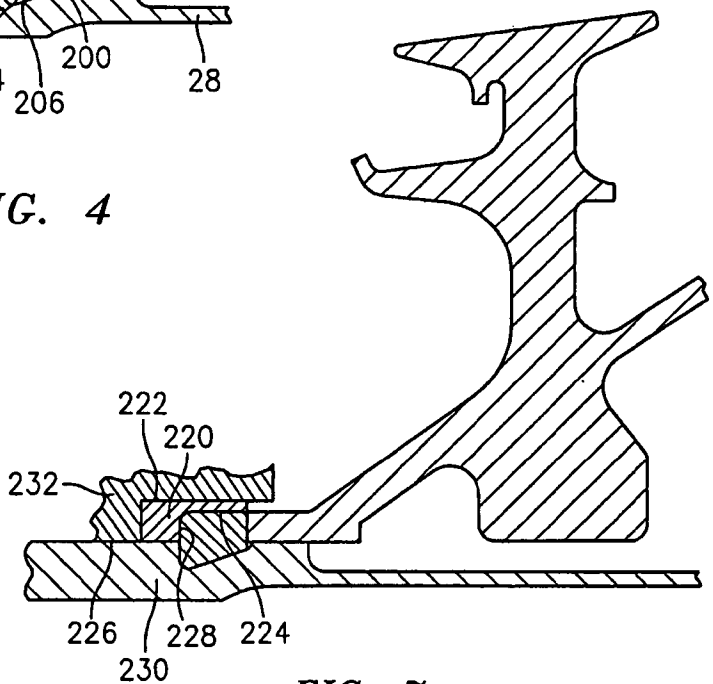
FIG. 7 is a longitudinal sectional view of the leading a third stage of installation.

With the segments in place, a segment retaining means may be provided. In the exemplary retainer, this includes a full annulus retaining ring 220 (FIG. 7) having an outboard surface 222 and a stepped inboard surface having: an aft portion 224 of corresponding diameter and extent to the segment outboard surface 218; and a smaller fore portion 226. The fore portion 226 is separated from the aft portion 224 by a radial shoulder 228 and the fore portion 226 has a diameter corresponding to that of an adjacent portion 230 of the shaft. In the exemplary embodiment, the retaining ring may be slid (translated) into position and held in that position by the subsequent insulation of a bearing retainer 232 for the bearing system 30 thereahead. Alternatively or additionally, there may be a threaded or other locking engagement between the surface portions 230 and 226. With the precompressive retainer 84 thus installed, the applied force may be released, permitting the rotor stack to slightly decompress. The release brings the rim surface 82 into engagement with the segment aft surfaces 214. With the rim surface 82 bearing against the retainer segments 210A and 210B, the retainer segment fore surfaces 212 bear against the rebate fore surface 204 to transmit force between the rotor stack and the shaft 28. The result is to leave the rotor stack with a residual precompressive force and the portion 56 of the shaft 28 within the rotor stack with an equal and opposite pretension force. An exemplary precompression force is 50-200 kN. Advantageous force will depend upon the size of the rotor stack, with longer stacks requiring greater force. To achieve this, the assembly precompression force may be slightly greater (e.g., by 5-20%).

In operation, as the rotor stack rotates, inertial forces stress the rotor stack. The rotation-induced tensile forces increase with radius. Exemplary engine speeds are 5,000-20,000 rpm for smaller engines and 10,000-30,000 rpm for larger engines. At high engine speeds, the inertial forces on outboard portions of a simple annular component could produce tensile forces in excess of the material strength of the component. It is for this reason that disk bores are ubiquitous in the art. By placing a large amount of material relatively inboard (and therefore subject to subcritical stress levels) some of the supercritical stress otherwise imposed on outboard portions of the disk may be transferred to the bore. The supercritical tensile forces are particularly significant for the spacers. With non-arcuate spacers, the rotation tends to bow the spacer outward into a convex-out shape. This may produce very high tensile stresses near the outboard surface of the spacer. Care must be used to insure that this does not cause failure. This may constrain the use of non-arcuate spacers. For example, the spacer's length may be substantially restricted and thus the associated disk-to-disk span. The spacers may be restricted in radial position to relatively inboard locations. The spacer may require their own bores for reinforcement.

In the exemplary engine, the orientation and relative inboard location of the first spacer 62A permits its non-arcuate nature. The remaining spacers are concave outward. Outward centrifugal loading tends to partially straighten the spacers, reducing their characteristic concavity (e.g., a particular local or average inverse of radius of curvature). However, this straightening is resisted by the compression in the disk stack causing an increase in the compression experienced by the spacer rather than a supercritical tensile condition. Thus, as the rotational speed increases, the compression force across the stack will tend to increase. This increase in compression force has a number of additional implications. One set of implications relates to the spacer configuration. By countering the inertial tensile forces experienced by the spacers, the spacers may be shifted outboard relative to a corresponding engine (e.g., a baseline engine being reengineered) with straight spacers. This outward shift may increase rotor stiffness. The outward shift also permits the outboard interdisk cavities to decrease in size. This size decrease may help increase stability by reducing gas recirculation in these cavities. This may reduce heat transfer to the disks. Additionally, the arcuate spacers may permit an increase in the disk-to-disk spacing $L_2$. This spacing increase may permit use of blade and vane airfoils with longer chords. For example, in a given overall rotor length, fewer disks may be used to obtain generally similar performance (e.g., dropping one or two disks from a baseline 7-10 disk rotor stack). This reduction in the number of disks may reduce manufacturing costs.

Other advantages may relate to the change in the compression profile (i.e., the relationship between speed and longitudinal compression force across the rotor stack). For example, the reengineered system may have compression that essentially continuously increases with engine speed from a static condition to an at-speed condition such as a maximum speed condition. This compression profile may be distinguished from a baseline configuration wherein the peak compression force is at a static condition and there is a continuous decrease with speed. One or more advantages or combinations may be achieved in such a reengineering. First, if the reengineered at-speed longitudinal compression force is higher than the baseline at-speed compression force, there is better engagement between the spacers and disks thereby reducing galling or other damage/wear at their junctions and prolonging life. Second, the static precompression force may be substantially reduced relative to the baseline configuration (e.g., to 20-50% of the baseline force). This reduction may also reduce stress-related fatigue and prolong life. This reduction may also ease manufacturing.

The configuration of the retainer 84 may have one or more advantages independent of or in combination with advantageous properties of the rotor stack. The exemplary retainer 84 may be contrasted with a simple nut retainer against which the rotor stack would bear and through the threads of which the precompression forces would be passed to the shaft. Nevertheless, it may be seen that such a nut retainer might be used in combination with inventive features of the rotor stack. One disadvantage which may be reduced or eliminated is the galling or fatigue-induced damage to the shaft and retainer threads. Eliminating or reducing this damage source may help prolong engine life. Other potential advantages involve ease of assembly and/or reducing the chances of damage during assembly. For example, the chances of damage to the threads from cross threading may be eliminated.

One or more embodiments of the present invention have been described. Nevertheless, it will be understood that various modifications may be made without departing from the spirit and scope of the invention. For example, when applied as a reengineering of an existing engine configuration, details of the existing configuration may influence details of any particular implementation. Accordingly, other embodiments are within the scope of the following claims.

What is claimed is:

1. A method comprising:

assembling a rotor stack to a turbine engine shaft;

exerting force to at least one of the rotor stack and the shaft;

inserting at least two retainer segments into a rebate in the shaft, the segments being separate pieces; and releasing the exerted force to permit the rotor stack to bear against the retainer segments.

2. The method of claim 1 wherein the exerting comprises:

exerting force between the rotor stack and the shaft to place the shaft under tension and the rotor stack under compression.

3. The method of claim 2 wherein said one or more retainer segments are exactly two retainer segments.

4. The method of claim 3 wherein each of the retainer segments is under 180° of arc.

5. The method of claim 1 wherein each of the retainer segments has an arc span effective to leave gaps between adjacent segment ends so that the segments do not interfere with each other.

6. The method of claim 5 wherein:

the segment ends are circumferential ends.

7. The method of claim 1 further comprising:

installing a collar at least partially surrounding the retainer segments so as to secure the retainer segments in place against radial displacement.

8. The method of claim 7 further comprising:

longitudinally restraining movement of the collar by a bearing support element.

9. The method of claim 7 wherein:

the installing of the collar consists of a translation.

10. The method of claim 7 wherein:

the installing of the collar does not involve threaded engagement of the collar.

11. The method of claim 2 wherein:

the exerting compresses the rotor stack with a force in excess of 50 kN.

12. The method of claim 2 wherein:

the releasing leaves the rotor stack under a precompression force of at least 50 kN.

13. The method of claim 2, wherein:

the assembling includes interference fitting an end portion of at least one spacer element within a portion of at least one rotor disk.

14. The method of claim 2 wherein the rebate is radially outwardly open and a forward surface of the rebate engages the retainer segments to resist a force from the rotor.

15. The method of claim 2 further comprising:

running the shaft and rotor, a force transmitted across the retainer segments between the shaft and rotor increasing with speed of the rotation.

16. The method of claim 2 further comprising:

rotating the shaft and rotor, a force transmitted across the retainer segments between the shaft and rotor essentially continuously increasing with speed of the rotation from a static condition to an at-speed condition.

17. The method of claim 1 wherein the exerting force to at least one of the rotor stack and the shaft comprises at least one of:

placing the shaft under tension; and placing the rotor stack under compression.

18. The method of claim 17 wherein:

the releasing leaves the rotor stack under a precompression force of at least 50 kN and the shaft under a pretension force of at least 50 kN.

19. The method of claim 1 wherein:

the releasing leaves the rotor stack under a precompression force of at least 50 kN and the shaft under a pretension force of at least 50 kN.

20. The method of claim 1 wherein:

the exerting force comprises compressing the rotor stack.

21. The method of claim 1 wherein:

the exerting is before the inserting and the releasing is after the inserting.

22. The method of claim 1 wherein:

the releasing causes the rotor stack to bear against the retainer segments.

* * * * *